US011468735B2

(12) United States Patent
Timperley et al.

(10) Patent No.: US 11,468,735 B2
(45) Date of Patent: Oct. 11, 2022

(54) SCALABLE GRAPHICAL PROCESS UNIT IN A GAMING SYSTEM

(71) Applicant: IGT, Las Vegas, NV (US)

(72) Inventors: James W. Timperley, Reno, NV (US); Jerrod Laputz, Sparks, NV (US); Tai Rosander, Reno, NV (US); Stewart Thoeni, Reno, NV (US)

(73) Assignee: IGT, Las Vegas, NV (US)

( * ) Notice: Subject to any disclaimer, the term of this patent is extended or adjusted under 35 U.S.C. 154(b) by 737 days.

(21) Appl. No.: 15/854,933

(22) Filed: Dec. 27, 2017

(65) Prior Publication Data

US 2019/0197824 A1 Jun. 27, 2019

(51) Int. Cl.
*G07F 17/32* (2006.01)

(52) U.S. Cl.
CPC ..... *G07F 17/3227* (2013.01); *G07F 17/3211* (2013.01); *G07F 17/3288* (2013.01); *G07F 17/3213* (2013.01); *G07F 17/3246* (2013.01); *G07F 17/3248* (2013.01); *G07F 17/3293* (2013.01)

(58) Field of Classification Search
CPC ..... G07F 17/3202; G07F 17/3227; G07F 17/3211; G07F 17/3288; G07F 17/3248; G07F 17/3293; G07F 17/3246; G07F 17/3213
See application file for complete search history.

(56) References Cited

U.S. PATENT DOCUMENTS

2003/0156385 A1* 8/2003 Askeland ..... G06F 1/182 361/679.51
2006/0247022 A1* 11/2006 Greiner ..... G07F 17/32 463/25
2009/0160733 A1* 6/2009 Chiba ..... G06F 3/1423 345/1.3
2010/0007668 A1* 1/2010 Casparian ..... G09G 5/363 345/505
2011/0169840 A1* 7/2011 Bakalash ..... G06T 1/60 345/505
2013/0303264 A1* 11/2013 Gill ..... G07F 17/3216 463/25
2015/0009221 A1* 1/2015 Jadhav ..... G09G 5/006 345/502
2016/0117793 A1* 4/2016 Sierra ..... G06T 1/20 345/502
2018/0046225 A1* 2/2018 Amarilio ..... G06F 1/1601
2018/0350190 A1* 12/2018 Wen ..... G07F 17/3216
2019/0130519 A1* 5/2019 Hu ..... G06F 1/206

* cited by examiner

*Primary Examiner* — Jay Trent Liddle
*Assistant Examiner* — Jason Pinheiro
(74) *Attorney, Agent, or Firm* — Sheridan Ross P.C.

(57) ABSTRACT

Various embodiments are provided for scalable graphical processing unit (GPU) functionality in electronic gaming machines (EGMs). The EGM may include a base component to house an enclosed master gaming controller (MGC). The enclosed MGC may have one or more graphics card expansion ports located externally to the enclosed MGC. The EGM may include a display device, supported by the base component, to display one or more images of one or more games. The EGM may include a graphics accelerator component housed within the display device to enhance one or more images associated with one or more games on the display device.

20 Claims, 10 Drawing Sheets

595

| | Feature | | |
|---|---|---|---|
| | On board | Add-In card | Graphics Acc. |
| Level 1 | X | | |
| Level 2 | X | X | |
| Level 3 | X | | X |
| Level 4 | X | X | X |

1300

SCALABLE GRAPHICAL PROCESS UNIT IN A GAMING SYSTEM

BACKGROUND

The present disclosure relates in general to gaming devices and systems and more particularly, to a scalable graphical processing unit in a gaming system.

Games of chance have been enjoyed by people for many years and have undergone increased and widespread popularity in recent times. As with most forms of entertainment, some players enjoy playing a single favorite game, while others prefer playing a wide variety of games. In response to the diverse range of player preferences, gaming establishments commonly offer many types of electronic games. Many electronic gaming machines (EGMs), such as slot machines and video poker machines, have been a cornerstone of the gaming industry for several years. The EGMs include specially programmed computers and contain multiple external interfaces.

BRIEF SUMMARY

Various embodiments are disclosed for improving gaming technology by providing a scalable graphical processing unit (GPU) incorporated into an EGM. In some embodiments, the EGM may include a base component to house the scalable GPU. The scalable GPU may have one or more graphics card expansion ports. The EGM may include a display device, supported by the base component, to display one or more images. The EGM may include a graphics accelerator housed within the display device to enhance one or more images associated with one or more games on the display device. Other exemplary embodiments are disclosed herein and supply related advantages.

The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Aspects of the present disclosure are illustrated by way of example and are not limited by the accompanying drawings.

DETAILED DESCRIPTION

Figure 1:
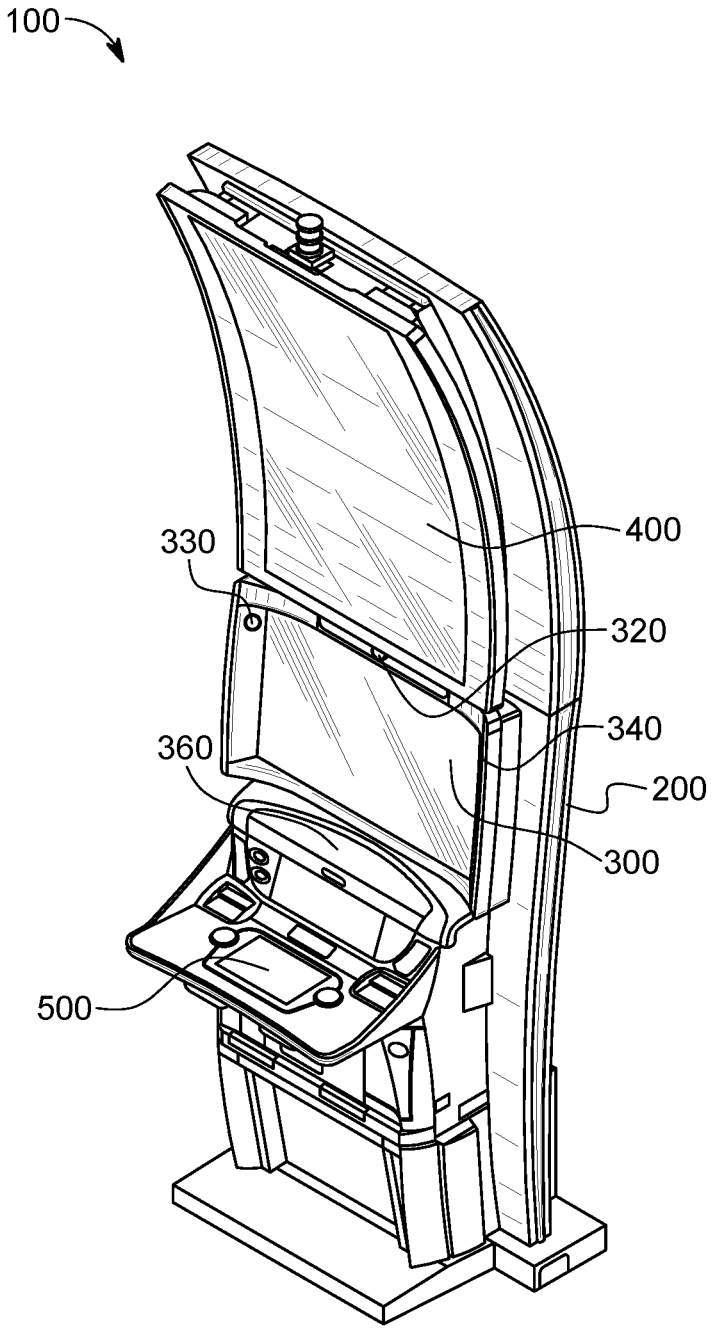
FIG. 1 is a front perspective view of one example embodiment of the electronic gaming machine (EGM)

Various aspects of the presently disclosed technology provide graphical processing and computing enhancements of EGMs, and methods of operating such enhanced EGMs. For brevity and clarity, and unless specifically stated otherwise, the term "EGM" is used herein to refer to any electronic gaming machine known in the art (such as but not limited to a slot machine, a video poker machine, a video card machine, a video lottery terminal (VLT), a video keno machine, a video bingo machine, etc.). Again for brevity, the term "3D images" used herein is understood to include any 3D image or other content shown in 3D (such as, but not limited to, moving or transforming 3D geometries, 3D videos, movies, etc.).

An EGM may provide certain processing units (e.g., within a gaming logic box/master gaming controller (MGC)) that execute and display various gaming applications on the EGM. A focus of EGM manufacturers and gaming institutions is to, like many other computer arts, increase the computing efficiency of the EGM so as to provide a more satisfying gaming experience to the player (e.g., by lowering game latency, increasing frame rates, etc.). However, to achieve such enhanced gaming and computing efficiency, it is critical for the EGM to provide images, audio, and video that equally match a style, type, and functionality intended by the creators of the various gaming applications, which may be provided by a third party vendor. For example, some gaming applications necessitate the EGM to display a lower graphical display resolution (and thus demanding a lower graphical processing capability) while other gaming applications command a much higher graphical display resolution (and thus demanding a higher graphical processing capability) in order to display the game properly and accurately on the EGM. Thus, merely manufacturing a "one size fits all" type EGM having a certain graphical or computing processing capability is not practical, as gaming applications vary widely with regard to the performance requirements placed upon the EGM. Moreover, when manufacturing an EGM with only pre-set graphical or computing processing capabilities, situations may arise where the processing components of the EGM are constantly underutilized (or over utilized), depending on which gaming application the EGM is executing.

In view of the foregoing, the functionality of the instant disclosure provides an EGM with a base component housing all gaming electronics (such as processing components and storage components storing gaming applications), circuitry, and peripheral devices (including human interaction interface (HMI) devices). A display component may be mounted to the base component. The display component may include a primary display device and a secondary display device. The primary display device may include a small form-factor (SFF) enclosure housing a mini-ITX central processing unit/motherboard with onboard GPU and peripheral component interconnect-express (PCIe) connections for scalable upgrades via the addition of an external graphics card and the use of a graphics accelerator. The graphics accelerator may be housed within the secondary display device. The external graphics card may be added to an external slot of the SFF enclosure. The external graphics card adds additional performance and computational power, thus raising resolution quality and image enhancement to an underperforming onboard graphics video card housed within the SFF enclosure. That is, the additional graphics video card may be added to the EGM in conjunction with an existing onboard graphics video card and used together with the onboard graphics video card.

In addition, for high performance video capability, the external slot may be used to attach a PCIe cable to the graphics accelerator. This enables the EGM to provide scalable performance at a modest cost for a gaming operator. Also, the EGM may provide multiple displays within and/or outside the display component thus reducing costs for multiple cabinet products.

In one aspect, the EGM may comprise at least two main components: 1) a base component and 2) a display component. The base component may house all gaming components such as, for example, a power conditioner/distribution, power supply, logic box (including a logic board having processing components thereon), cabinet controller, button panel controller, light controller, sound amplifier, voice activated or voice-initiated device, biometric detection or tracking devices (e.g., retinal, facial, and hand gesture detection devices), printer, and bill validator. The base component may also include an HMI such as, for example, a digital and/or static button panel, bill entry, ticket guide, and universal serial bus ("USB") charging port.

In one aspect, the logic box or MGC may have a built-in GPU and expansion port for video card upgrades that are externally acceptable. Thus, the scalable GPU may operate in a first level by only using the onboard (built-in) GPU. In one aspect, a video card may comprise a display card, graphics card, display adapter, or graphics adapter. The video card (e.g., "graphics card") generates a feed output of images to display on a display device of the EGM. In a second level, the EGM may use both the onboard GPU, one or more external ports, and one or more additional video cards. In an advanced or "premium level", the EGM may use the onboard GPU, one or more external ports, one or more additional video cards, and a graphics accelerator. Additionally and/or alternatively, the advanced or premium level may use only the onboard GPU and the graphics accelerator. A PCIe cable may connect the external port and the graphics accelerator. The graphics accelerator may be housed in a divided and separated area of the logic box in the display device so as to dissipate heat or cool the EGM and associated components. In other words, the display device may also be scalable wherein the first architectural level would only house the logic box or primary display elements such as, for example, full high-definition (HD) panels and/or stepper reels. If higher end display devices such as 3D devices, 4 k devices (e.g., a 4 k display having an ultra HD 'UHD' resolution of 3840 pixels×2160 lines or 8.3 megapixels), and/or 8 k devices (an 8 k display having a UHD resolution of 7680 pixels×4320 lines or 33.2 megapixels) are needed, a graphics accelerator may be added as the premium level configuration. The graphics accelerator may drive or power the 3D, 4 k, and 8 k display devices as well as any other devices external to the EGM.

In one aspect, the EGM may include: (a) a base component; (b) a display device supported by the base component; (c) an enclosed MGC housed within the base component; (d) one or more graphical processing unit (GPU) add-in cards external to the MGC; (e) at least one processor housed within the enclosed MGC; and (f) at least one memory device housed within the enclosed MGC and storing a plurality of computer instructions.

The EGM may include a small form-factor enclosure housing the graphics accelerator(s) in the first display device. The graphics accelerator module (the small form-factor enclosure) may include a PC motherboard, one or more PCIe connection means (e.g., PCIe cables), at least one graphics card, one or more graphics card expansion ports, or a combination thereof. The one or more graphics card expansion ports may be externally located on the small form-factor enclosure. The PCIe connection means may be coupled to the one or more graphics card expansion ports and the graphics accelerator. The EGM may also include the base cabinet having at least a power supply, one or more peripheral devices, one or more HMI devices, and one or more means for receiving a wager or performing a cash-out operation. The graphics accelerator may include at least one or more additional graphics cards, a power supply, an air exhaust system, a PCB connection means, and an air inlet. The graphics accelerator may additionally be coupled to one or more additional display devices of a plurality of additional EGMs (such as in a 'bank' of EGMs).

To wit, the present disclosure considers technology allowing for GPU add-in cards to be placed externally to the logic box or MGC. The GPU add-in cards may plug directly into ports on the MGC that are externally accessible, as will be further described. In additional embodiments, additional GPUs may be included in the system in a module or area of the EGM connected by a serial interface (PCIe, Thunderbolt, USB-C). This module may be termed herein as a "graphics accelerator" that itself includes one or a multitude of expansion ports. Thus, because the system is easily scalable to suit the needs of the particular EGM, it hence becomes possible to support many more displays on a single EGM, or even an entire "bank" of displays with a single MGC and a multitude of GPUs within a single EGM.

This technology has many benefits. Because the system is much more flexible and scales easily, space is not limited to one particular logic box or MGC inside a single EGM (many more graphics cards may be employed than otherwise would be possible to connect within a single MGC). The external GPU technology also provide the ability to produce the MGC in a smaller form factor and thus easily incorporate the MGC anywhere in the EGM system. The external GPU technology further allows for GPU add-in cards to be installed which are physically larger than those which would otherwise fit in the MGC, and moreover, allows for more effective cooling solutions because the GPUs may be placed in an advantageously cooler area within the EGM cabinet (the graphics accelerator modules further house dedicated cooling fans, air inlets, and exhaust features). Still further, from a regulatory and security perspective, housing external GPUs to the logic area (MGC) allows upgrade, replacement, and expansion of the GPUs without breaking the MGC "seal", which preserves the integrity of the logic area housed therein. The system still further provides expandability, upgradability, serviceability, cost, and manufacturability benefits which will be apparent to one of skill in the art having the benefit of the present disclosure.

Referring now to FIG. 1, one exemplary EGM considered by the present disclosure is generally illustrated and indicated by numeral 100. The EGM 100 illustrated in FIG. 1 generally includes a support structure or cabinet 200 that supports a plurality of output devices and a plurality of input devices of the EGM 100, among other components. In one example embodiment, the plurality of output devices of the EGM 100 may include: (a) a first or intermediate display device 300; (b) a second or upper display device 400 positioned above the first or intermediate display device 300; and (c) a third or lower display device 500 positioned below the first or intermediate display device 300. These output devices are configured to display the games, game outcomes, awards (such as the primary and secondary game awards or other game outcome awards), and other functionality and information to the player. In this illustrated example embodiment, the plurality of player input devices enable the player to play one or more wagering games provided by the EGM. Such player input devices may also include one or more of the input devices. The player input devices are physically touchable or activatable by the player to enable the player to make inputs into the EGM. These output devices and input devices are configured such that a player may operate the EGM while standing or sitting, but preferably operates the EGM while the player is sitting in front of the EGM 100 such that the player's head is approximately at the same height as the first display device 300.

In an illustrated example embodiment, the first display device 300 of the EGM 100 may be configured to display one or more 3D images to the player without requiring the player to wear 3D glasses. This first display device 300 includes one or more lenticular lenses (not shown). In various embodiments, the first display device 300, including the lenticular lense(s), is configured to display or project what appears to the player as one or more 3D virtual objects that are projected towards the player or projected in a player interaction zone in front of the player. In various embodiments, the first display device 300, including the lenticular lense(s), may be configured to display or project what appears to the player as one or more 3D virtual objects that appear to the player to be behind the front face or screen of the display device. This 3D presentation illustrates a graphics-intensive workload on the EGM 100 for consideration with the mechanisms presented in the instant disclosure.

In an illustrated example embodiment, the EGM 100 may include one or more eye tracking or head tracking cameras such as eye tracking or head tracking camera 320 supported by the cabinet 200 and positioned directly above the display device 300. The eye tracking or head tracking camera 320 is configured to track the position of the player's eyes or the player's head as they move in front of the display device 300. More specifically, the eye tracking or head tracking camera 320 is configured to track the position of the player's eyes or the player's head as they move in an eye/head tracking zone. In the embodiments where two or more eye tracking or head tracking cameras are employed, such multiple cameras work together to track the position of the player's eyes or the player's head as they move in front of the display device 300. In various embodiments, such multiple cameras are spaced apart, such as spaced apart 6 inches.

In an illustrated example embodiment, the EGM 100 may include camera 330 that may be positioned directly to the right of the display device 300 (looking forward) and one camera 340 positioned directly to the left of the display device 300 (looking forward). In this illustrated embodiment, the plurality of cameras 330 and 340 are positioned adjacent to an upper left hand corner or upper right hand corner of the display device 300 and the other of the plurality of cameras is positioned adjacent to an upper right hand corner of the display device 300. It should be appreciated that in an alternative embodiment, the plurality of cameras may be positioned adjacent to a lower right hand corner of the display device 300 and positioned adjacent to a lower left hand corner of the display device 300.

In certain embodiments, the EGM 100 creates object depth images using point clouds provided by time of flight depth cameras and merges these point clouds to create one optimized point cloud that represents the object(s), such as the player's hand(s) in the right and left player hand tracking zones. In various other embodiments, the EGM uses image data provided by the cameras 330 and 340 to determine the closest depth of the end of the player's hand(s). In other words, in these alternative embodiments, the EGM determines the nearest point (i.e., the xyz coordinate relative to the display device 300) of the object such as the player's hand to the display device 300, and then uses that point as the reference for providing the tactile feedback to the player in real time or substantially real time. In various other embodiments, the EGM uses the image data provided by the cameras 330 and 340 to determine movements or gestures by the player's hand(s). In these embodiments, the EGM uses the determined gestures to provide tactile feedback to the player in real time or substantially real time.

In various embodiments, the EGM 100 may include one or more audible sound producing devices (such as speakers) that produce sounds that are coordinated with haptic tactile feedback provided to the player by the EGM 100 to further enhance the physical player interaction in conjunction with game play or other functionality provided by the EGM 100 to the player. In various embodiments, a sound chair (not shown) may be associated with the EGM 100 and includes one or more audible sound producing devices (such as speakers) that produce sounds that are coordinated with haptic tactile feedback provided to the player by the EGM 100 to further enhance the physical player interaction in conjunction with game play or other functionality provided by the EGM 100 to the player.

Figure 2:
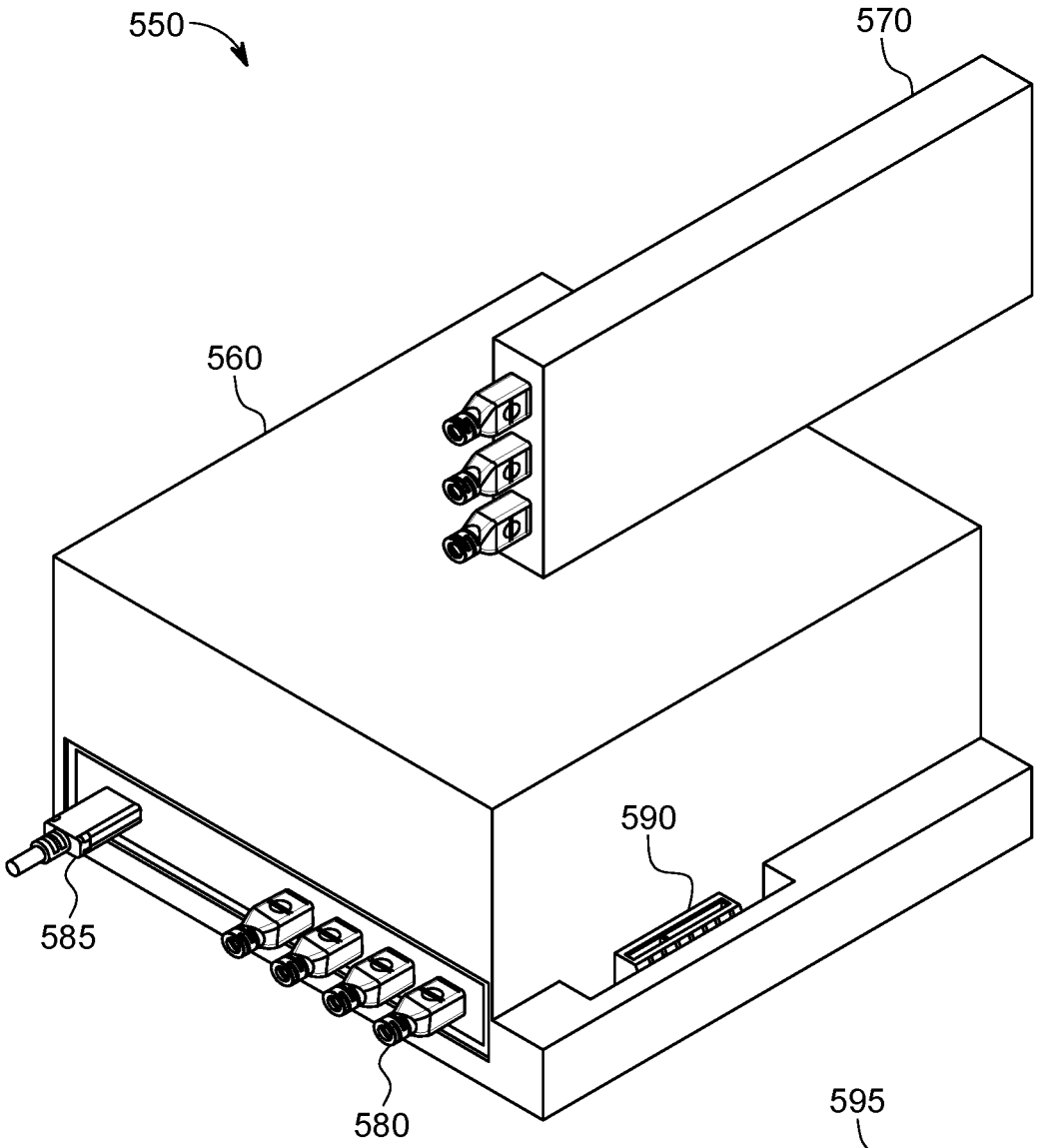
FIG. 2 is a schematic block diagram of a scalable GPU architecture.

Turning now to FIG. 2, a block diagram of a scalable GPU 550 is depicted. The scalable GPU 550 may include a SFF enclosure 560. In one aspect, the SFF enclosure may have a defined shape and size such as, for example, having a substantially square shape of 7.2 inches in width and 7.2 inches in length and 3.6 inches in depth. These dimensions are for illustrative purposes only and may vary depending on the type of EGM and where the GPU 550 is to be deployed. The SFF enclosure 560 may include a PC motherboard, one or more connection means 585 such as, for example, a PCB connection means (e.g., PCIe cables), at least one on-board graphics card (not depicted inside of the SFF enclosure 560), one or more graphics card ports 580, or a combination thereof. An external graphics card port 590 may be included on the SFF enclosure 560. One or more graphics cards 570 (e.g., external graphics card 570) may be coupled to the external graphics card expansion port 590 to enhance image quality and/or game play in combination with the board graphics card. In one aspect, the one or more graphics card expansion ports 590 may be externally located on the SFF enclosure 560.

Figure 3:
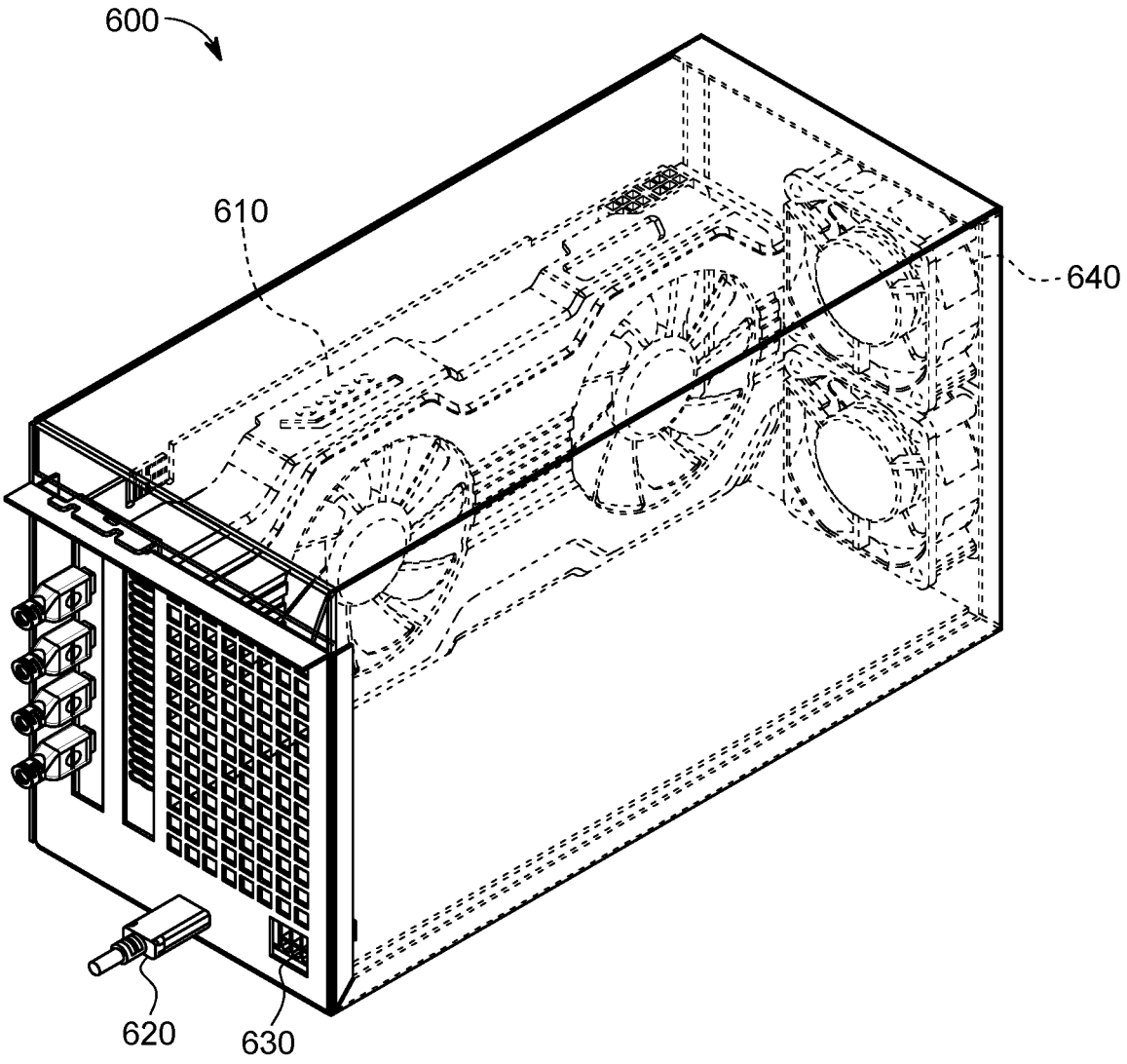
FIG. 3 is a schematic block diagram of a graphics accelerator.

In one aspect, as depicted in table 595, the scalable GPU 550 may provide one or more scalable levels of performance such as, for example, level 1, level 2, level 3, and level 4. As illustrated in table 595, level 1 may include the GPU 550 operating in the EGM 100 using only an on-board graphics card. Level 2 indicates that GPU 550 may be operating in the EGM 100 using an on-board graphics card and one or more external graphics cards 570. Level 3 indicates that the GPU may be operating in the EGM 100 using an on-board graphics card and a graphics accelerator 600, as depicted in FIG. 3. Level 4 indicates that the GPU may be operating in the EGM 100 using an on-board graphics card, one or more external graphics cards 570, and a graphics accelerator 600.

Turning now to FIG. 3, a block diagram of a graphics accelerator 600 is depicted. In one aspect, graphics accelerator 600 includes at least one or more additional graphics cards 610, a power supply 630 (e.g., a direct current 'DC' power in), an air exhaust system 640 (e.g., cool air inlet), and a PCB connection means 620. The graphics accelerator 600 may be coupled to one or more additional display devices of a plurality of additional EGMs (such as a 'bank' of EGMs physically located beside one another).

Referring now to FIGS. 4, 5, 6, 7, and 8, the EGM 100 of the present disclosure is generally illustrated showing levels 1-4 (see table 595 of FIG. 5), as described above. This exemplary EGM 100 illustrated in FIGS. 4, 5, 6, 7, and 8 generally includes a support structure or cabinet 200 that supports a plurality of output devices and a plurality of input devices of the EGM 100, among other components. In this illustrated example embodiment, the plurality of output devices includes: (a) a first or intermediate display device 300; (b) a second or upper display device 400 positioned above the first or intermediate display device 300; and (c) a third or lower display device 500 positioned below the first or intermediate display device 300. As depicted in FIGS. 4, 5, 6, 7, and 8, portions of the first or intermediate display device 300 and second or upper display device 400 have been removed or "detached" so as to illustrate the internal chambers/compartments of the first or intermediate display device 300 and second or upper display device 400, or cabinet 200. In one aspect, the first or intermediate display device 300 and second or upper display device 400 are each individual display devices that may be coupled together.

Figure 4:
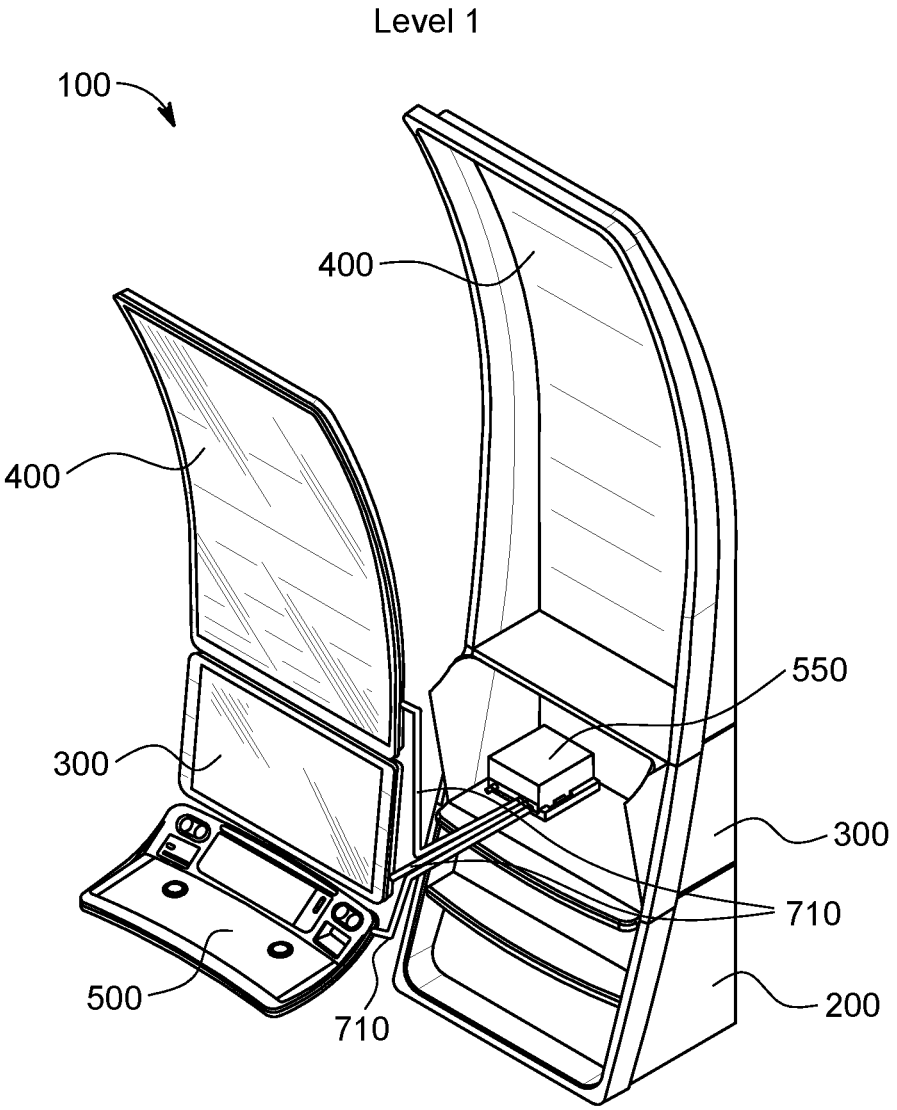
FIG. 4 is a schematic block diagram of the scalable GPU architecture of FIG. 2 in the EGM of FIG. 1.

As depicted in FIG. 4, level 1 depicts the EGM 100 having the scalable GPU 550 also included in the first or intermediate display device 300. The scalable GPU 550 may also be included or associated with cabinet 200. One or more connection means 710 (e.g., PCIe connection cables) may be used to connect the scalable GPU 550 to the first or intermediate display device 300, the second or upper display device 400, the third or lower display device 500, or a combination thereof. In one embodiment, the EGM 100 may use the scalable GPU 550 and use an on-board graphics card (not depicted but housed within the SFF enclosure 560 of FIG. 2) for the first or intermediate display device 300, the second or upper display device 400, the third or lower display device 500, or a combination thereof.

Figure 5:
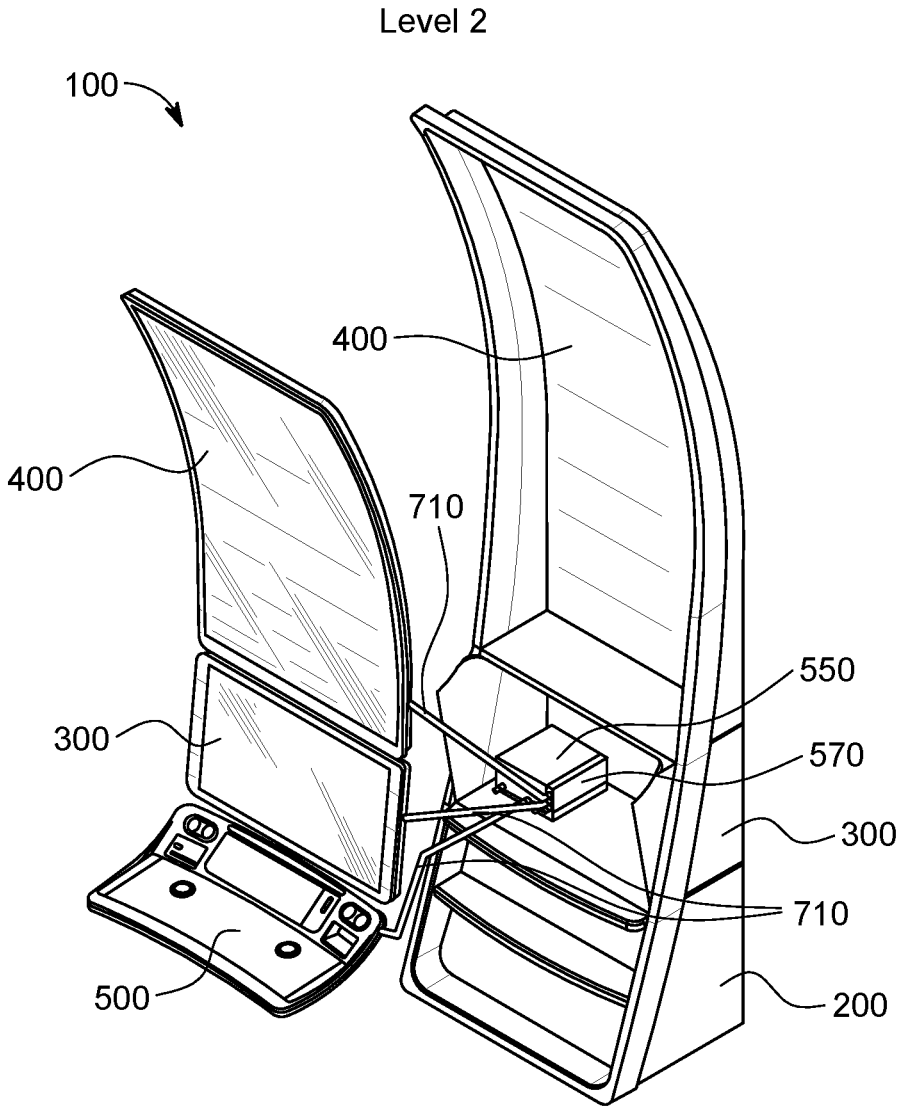
FIG. 5 is a schematic block diagram of a one or more graphics cards in the scalable GPU architecture of FIG. 2 in the EGM of FIG. 1.

FIG. 5 depicts level 2 with the EGM 100 having the scalable GPU 550 included in the first or intermediate display device 300. One or more external graphics cards such as, for example, graphics card 570 may be included on the GPU 550. That is, the external port 590 of the scalable GPU 550 may be coupled to the graphics card 570 for increasing performance, resolution, and display of one or more images. The scalable GPU 550 may be included or associated with cabinet 200. One or more connection means 710 (e.g., PCIe connection cables) may be used to connect the scalable GPU 550 to the first or intermediate display device 300, the second or upper display device 400, the third or lower display device 500, or a combination thereof. In one embodiment, the EGM 100 may use the scalable GPU 550 and use 1) an on-board graphics card (not depicted but housed within the SFF enclosure 560 of FIG. 5), and 2) the graphics card 570 for the first or intermediate display device 300, the second or upper display device 400, the third or lower display device 500, or a combination thereof.

Figure 6:
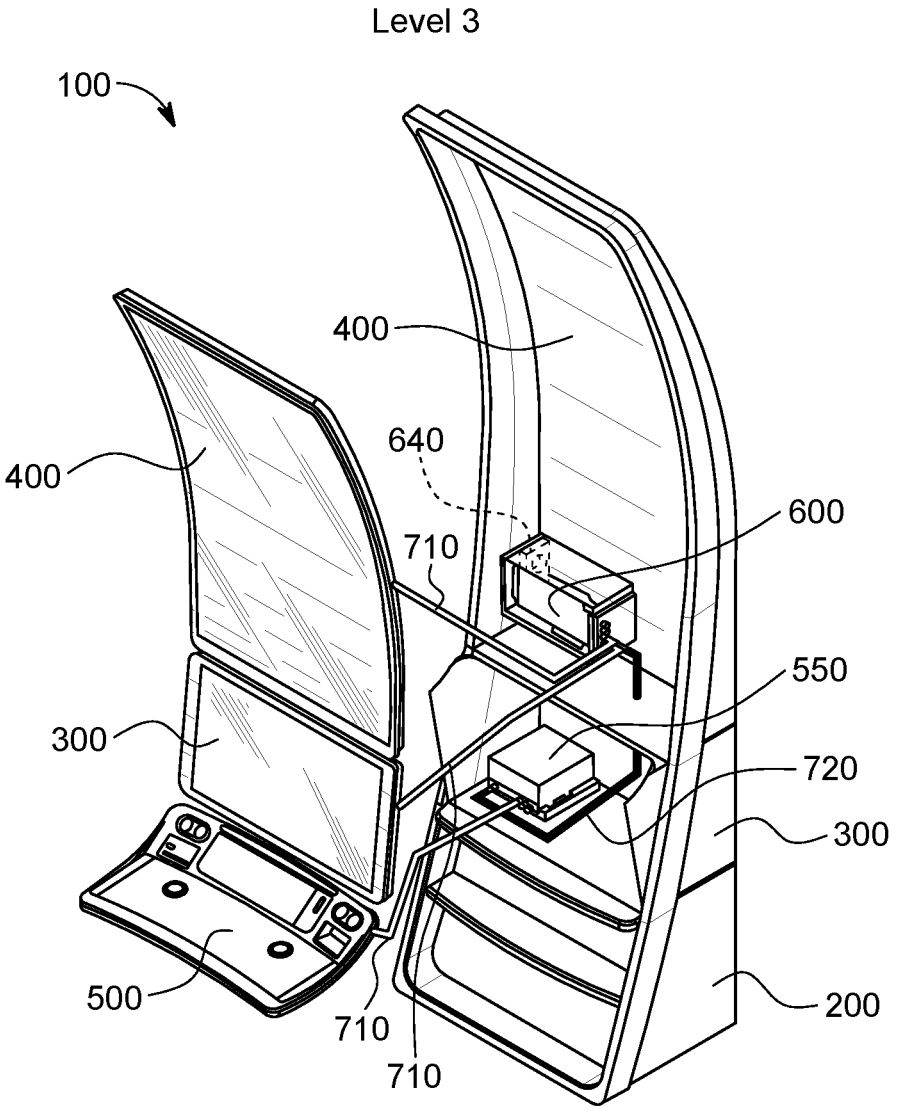
FIG. 6 is a schematic block diagram of a graphics accelerator of FIG. 6 and the scalable GPU architecture of FIG. 2 in the EGM of FIG. 1.

FIG. 6 depicts level 3 with the EGM 100 having the scalable GPU 550 included in the first or intermediate display device 300. The scalable GPU 550 may be included in or associated with cabinet 200. One or more connection means 710, 720 (e.g., PCIe connection cables) may be used to connect the scalable GPU 550 to the first or intermediate display device 300, the second or upper display device 400, the third or lower display device 500, or a combination thereof. In one embodiment, the EGM 100 may use the scalable GPU 550 and use an on-board graphics card (not depicted but housed within the SFF enclosure 560 of FIG. 5) and the graphics accelerator 600, having the air exhaust system 640, housed within the second or upper display device 400. In one aspect, the connection means 720 may connect the scalable GPU 550 to the graphics accelerator 600 such that the graphics accelerator 600 may boost and enhance the display of graphics of the first or intermediate display device 300, the second or upper display device 400, the third or lower display device 500, or a combination thereof.

Figure 7:
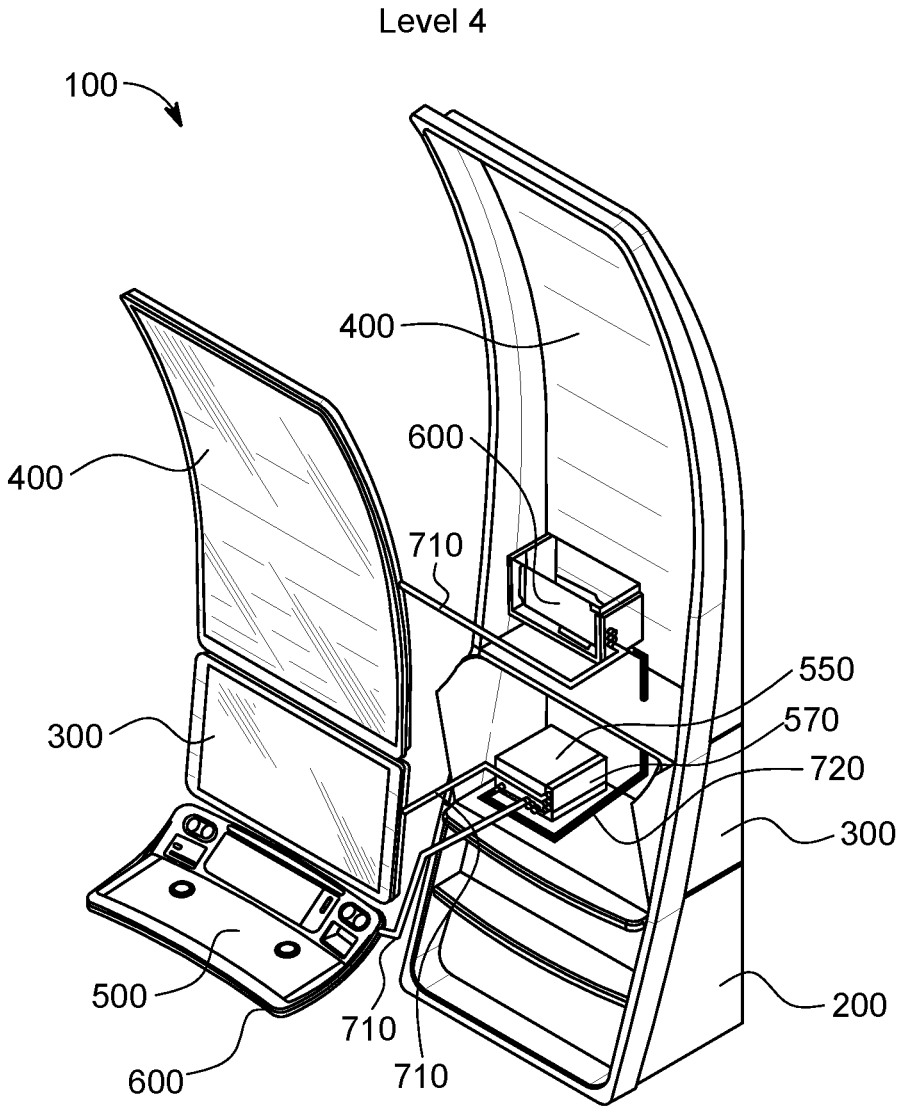
FIG. 7 is a schematic block diagram of one or more graphics cards in the scalable GPU architecture of FIG. 2 and a graphics accelerator of FIG. 3 in the EGM of FIG. 1.

FIG. 7 depicts level 4 with the EGM 100 having the scalable GPU 550 included in the first or intermediate display device 300. The scalable GPU 550 may be included in or associated with cabinet 200. One or more connection means 710 (e.g., PCIe connection cables) may be used to connect the scalable GPU 550 to the first or intermediate display device 300, the second or upper display device 400, the third or lower display device 500, or a combination thereof. Also, an additional connection means 720 (e.g., PCIe connection cables) may be used to connect the scalable GPU 550 to the graphics accelerator 600. In one embodiment, the EGM 100 may use the scalable GPU 550 and use an on-board graphics card (not depicted but housed within the SFF enclosure 560 of FIG. 2), one or more external graphics cards 570, and the graphics accelerator 600 housed within the second or upper display device 400.

Figure 8:
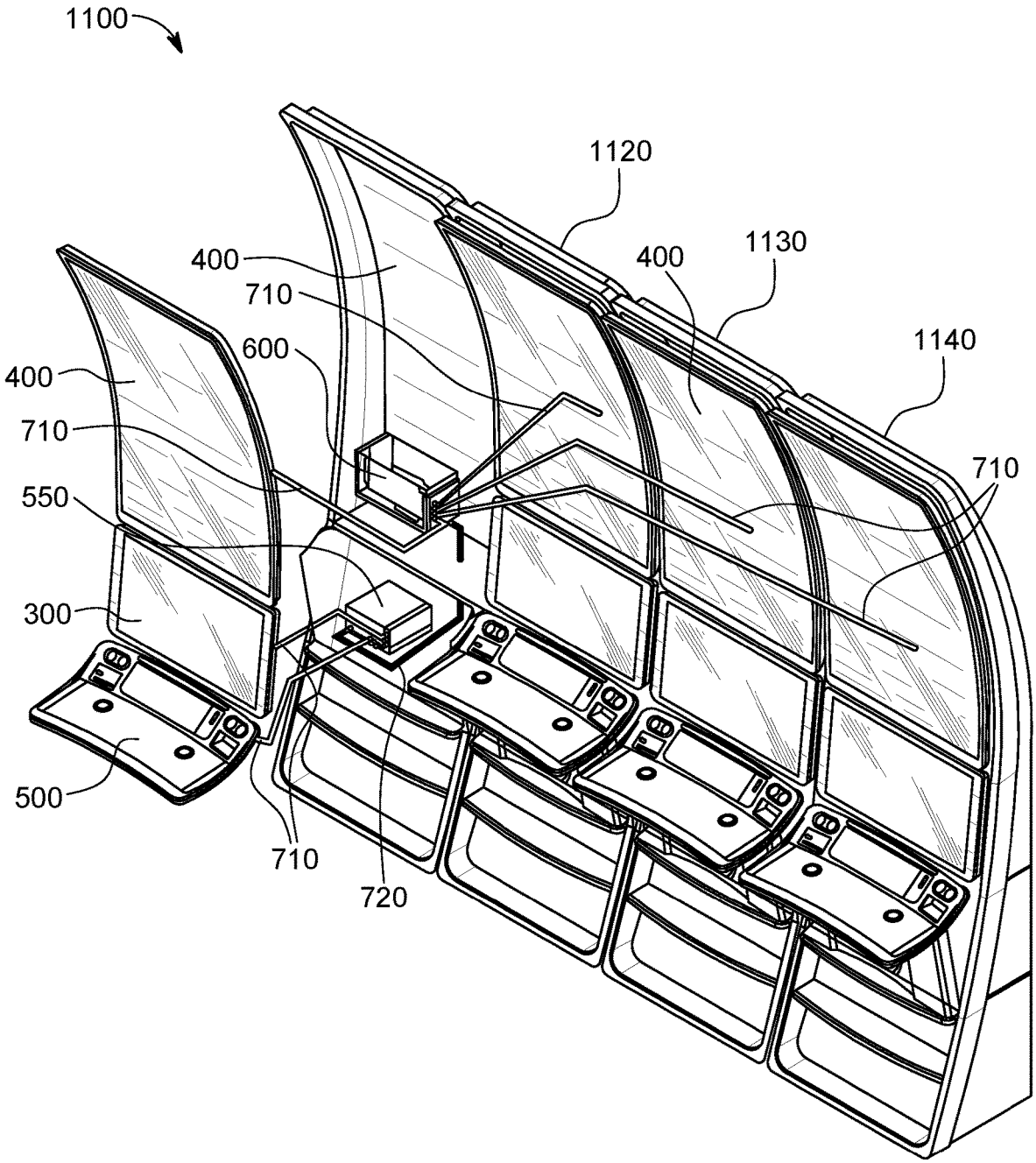
FIG. 8 is a schematic block diagram of a graphics accelerator of FIG. 3 in the EGM of FIG. 1 and coupled to additional display devices of multiple EGMs.

FIG. 8 depicts the EGM 1100 having the scalable GPU 550 included in the first or intermediate display device 300. The scalable GPU 550 may be included in or associated with cabinet 200, and additionally associated with EGMs 1120, 1130, and 1140. One or more connection means 710 (e.g., PCIe connection cables) may be used to connect the scalable GPU 550 to the first or intermediate display device 300, the second or upper display device 400, the third or lower display device 500, or a combination thereof. As depicted in FIG. 8, the one or more connection means 710 connect the scalable GPU 550 to the first or intermediate display device 300 and the third or lower display device 500.

Additional connection means 720 (e.g., PCIe connection cables, Thunderbolt cables, etc.) may be used to connect the scalable GPU 550 to the graphics accelerator 600. The one or more connection means 710 are also used to connect the graphics accelerator 600 directly to the second or upper display device 400. Furthermore, one or more connection means 710 are also used to connect the graphics accelerator 600 directly to the second or upper display device 400 of each additional EGM such as, for example, EGM 1120, 1130, and 1140.

Figure 9:
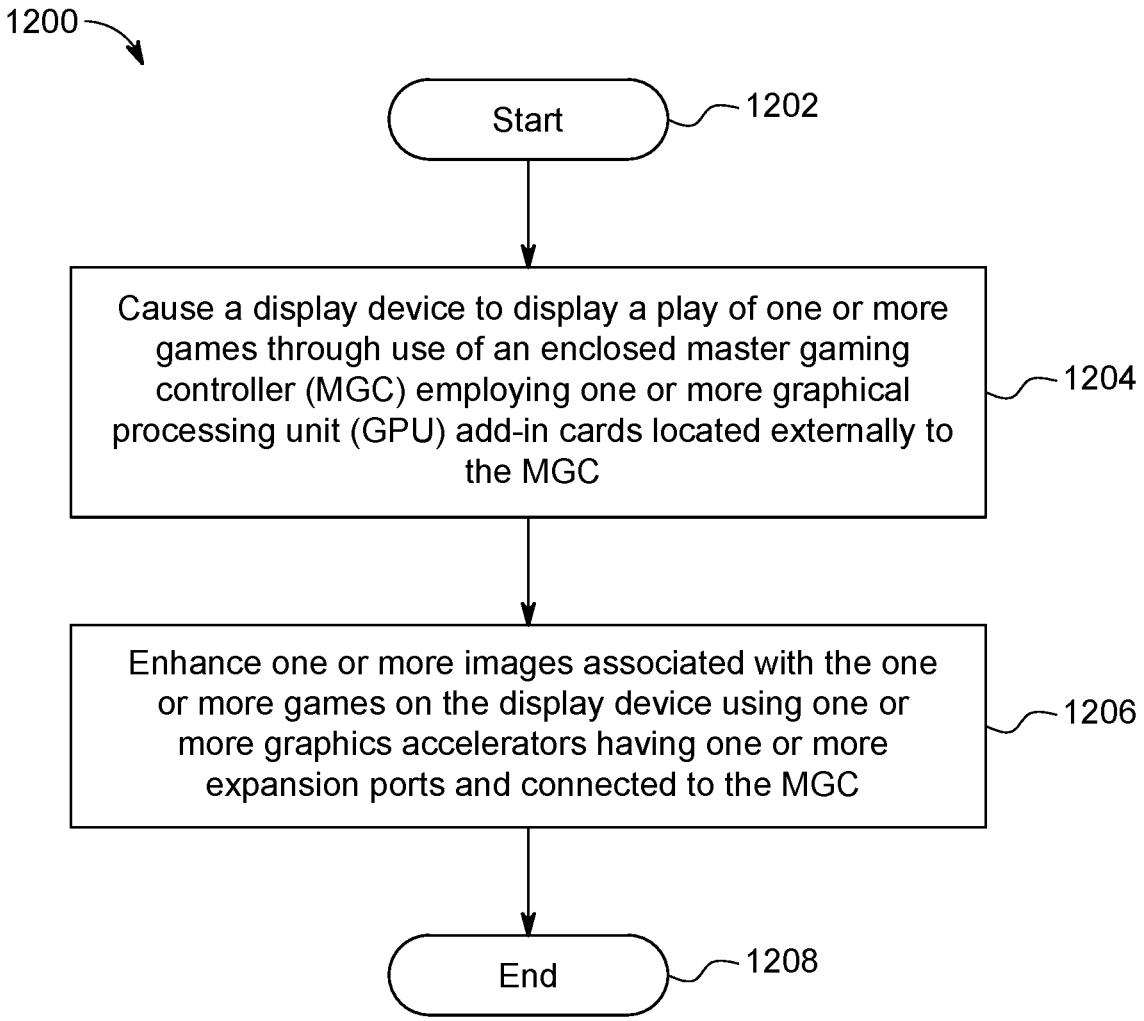
FIG. 9 a flowchart illustrating an exemplary method for implementing a scalable graphical processing unit in a gaming system.

Turning now to FIG. 9, a method 1200 for using a scalable GPU in a gaming system is depicted. The method 1200 begins in block 1202. An EGM may cause a display device to display a play of one or more games through use of an enclosed master game controller (MGC) employing one or more graphical processing unit (GPU) add-in cards located externally to the MGC, as in block 1204. The EGM may enhance one or more images associated with the one or more games on the display device using one or more graphics accelerators located externally to the enclosed MGC, the one or more graphics accelerators having one or more expansion ports and connected to the MGC, as in block 1206. The method 1200 ends in block 1208.

In one aspect, in conjunction with and/or as part of at least one block of FIG. 9, the operations of the method 1200 may include each of the following. In one aspect, the operations of the method 1200 may activate the graphics accelerator upon detecting one or more signals communicated via the MGC. The one or more images of one or more alternative display devices of additional gaming systems may also be enhanced.

It should be noted that the technology considered by the present disclosure is not limited to merely EGMs or casino gaming in general. Indeed, one of ordinary skill in the art would recognize that the mechanisms discussed herein are applicable to a wide variety of computing environments. For example, consider a gaming system such as a PlayStation® or XBOX® console, etc. Such a gaming console may include a "logic box" housed within the console itself (having an integrated processor, GPU, etc.), while having expansion ports for additional GPU add-in cards located somewhere externally on the device. In one embodiment, such a system may include plugging in an external (perhaps even third-party) GPU device into the console much like a cartridge-type game, only the "cartridge" is the additional GPU device. That is, the console itself may have expansion ports located externally or semi-externally to the console such that one or more additional GPU or graphics accelerator devices may be inserted into an opening of the console. In another embodiment, the console may have a serial interface connection, such as USB-C or Thunderbolt™, for connecting a graphics module fully housed externally to the console. In further embodiments, this type of system may be advantageously applicable to other devices, such as computer monitors or televisions. The computer monitor or television may include a slot for inserting a GPU add-in card to increase performance of the monitor or television without having to purchase an entirely new unit, while having the added benefit of implementing an additional GPU or graphics amplifier directly into the monitor or television itself. Aside from cost and upgradability benefits as discussed above, such an implementation may further provide cooling and on-demand performance assets associated with those benefits as previously stated.

The EGM 100 of the present disclosure may be controlled locally by one or more processors, and/or remotely or partially remotely by one or more remote processors, central servers, central controllers, or remote hosts. In various embodiments, the EGM 100 of the present disclosure may be part of a gaming system (which is also part of the present disclosure) that includes one or more EGMs (e.g., EGMs 1120, 1130, and 1140) in combination with one or more remote processors, central servers, central controllers, or remote hosts. In such embodiments, the EGM 100 is configured to communicate with the remote processors, central servers, central controllers, or remote hosts through a data network or remote communication link. In certain such embodiments, the EGM 100 is configured to communicate with one or more other EGMs through the same data network or remote communication link or through a different data network or remote communication link.

In certain embodiments in which the gaming system includes the EGM 100 in combination with a remote processor, central server, central controller, or remote host, the remote processor, central server, central controller, or remote host is any suitable computing device that includes at least one processor and at least one memory device or data storage device. As further described herein, the EGM 100 includes at least one EGM processor configured to transmit and receive data or signals representing events, messages, commands, or any other suitable information between the EGM 100 and the remote processor, central server, central controller, or remote host. The at least one processor of that EGM 100 is configured to execute the events, messages, or commands represented by such data or signals in conjunction with the operation of the EGM 100. Moreover, the at least one processor of the remote processor, central server, central controller, or remote host is configured to transmit and receive data or signals representing events, messages, commands, or any other suitable information between the remote processor, central server, central controller, or remote host and the EGM 100. One, more than one, or each of the functions of the at least one processor of the EGM 100 may be performed by the remote processor, the central server, the central controller, or the remote host.

In certain such embodiments, computerized instructions for controlling any games (such as any primary or base games and/or any secondary or bonus games) displayed by the EGM 100 are executed by the remote processor, central server, central controller, or remote host. In such "thin client" embodiments, the remote processor, central server, central controller, or remote host remotely controls any games (or other suitable interfaces) displayed by the EGM 100, and the EGM 100 is utilized to display such games (or suitable interfaces) and to receive one or more inputs or commands. In other such embodiments, computerized instructions for controlling any games displayed by the EGM 100 are communicated from the remote processor, central server, central controller, or remote host to the EGM 100 and are stored in at least one memory device of the EGM 100. In such "thick client" embodiments, the at least one processor of the EGM 100 executes the computerized instructions to control any games (or other suitable interfaces) displayed by the EGM 100.

In various embodiments in which the gaming system includes a plurality of additional EGMs (e.g., EGMs 1120, 1130, 1140), one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

Figure 10:
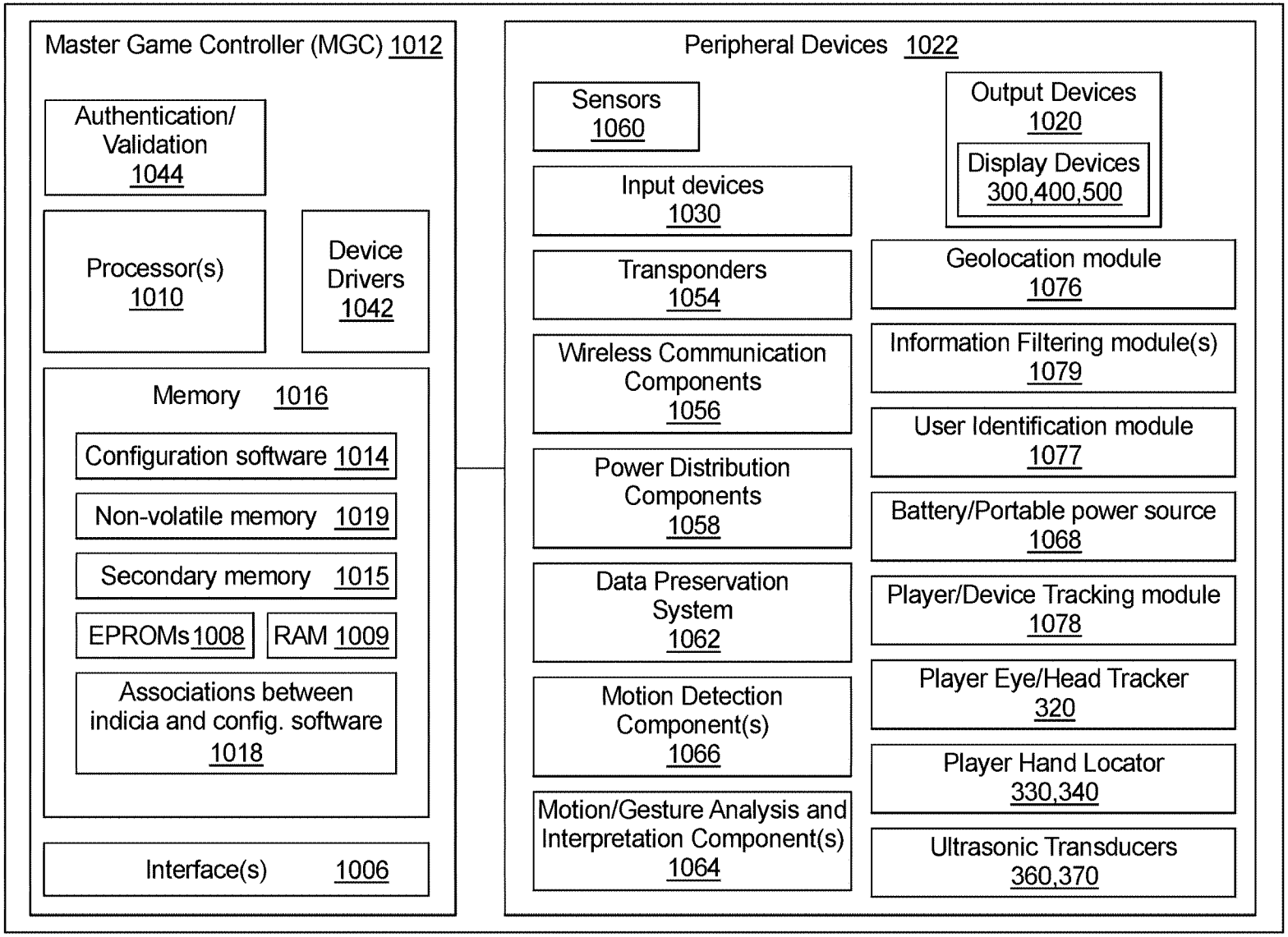
FIG. 10 is a schematic block diagram of one exemplary embodiment of the electronic configuration of the EGM of FIG. 1.

Referring now to FIG. 10, in various embodiments, an EGM 1300 includes an MGC 1012 configured to communicate with and to operate with a plurality of peripheral devices 1022 in addition to display devices 300, 400, 500, player eye/head tracker 320, player hand locators 330 and 340, and ultrasonic transducers 360.

The master game controller 1012 (e.g., a master gaming controller) includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM 1300; (4) communicating with interfaces and the peripheral devices 1022 (such as input/output devices); and/or (5) controlling the peripheral devices 1022. In certain embodiments, one or more components of the MGC 1012 (such as the at least one processor 1010) reside within a housing of the EGM 1300, while in other embodiments at least one component of the MGC 1012 resides outside of the housing of the EGM 1300.

The MGC 1012 also includes at least one memory device 1016, which includes: (1) volatile memory (e.g., RAM 1009, which may include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM 1300 disclosed herein. In certain embodiments, the at least one memory device 1016 resides within the housing of the EGM 1300 (described below), while in other embodiments at least one component of the at least one memory device 1016 resides outside of the housing of the EGM 1300.

The at least one memory device 1016 is configured to store, for example: (1) configuration software 1014, such as all the parameters and settings for a game playable on the EGM 1300; (2) associations 1018 between configuration indicia read from an EGM 1300 with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM 1300 to communicate with local and non-local devices using such protocols. In one implementation, the MGC 1012 communicates with other devices using a serial communication protocol. A few non-limiting examples of serial communication protocols that other devices, such as peripherals (e.g., a bill validator or a ticket printer), may use to communicate with the MGC 1012 include USB, RS-232, and Netplex (a proprietary protocol developed by IGT).

In certain embodiments, the at least one memory device 1016 is configured to store program code and instructions executable by the at least one processor of the EGM 1300 to control the EGM 1300. The at least one memory device 1016 of the EGM 1300 also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM 1300 through any suitable data network described above (such as an Internet or intranet).

The at least one memory device 1016 also stores a plurality of device drivers 1042. Examples of different types of device drivers include device drivers for EGM components and device drivers for the peripheral devices 1022. Typically, the device drivers 1042 utilize various communication protocols that enable communication with a particular physical device. The device driver abstracts the hardware implementation of that device. For example, a device driver may be written for each type of card reader that could potentially be connected to the EGM 1300. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (Wi-Fi), etc. In one embodiment, when one type of a particular device is exchanged for another type of the particular device, the at least one processor of the EGM 1300 loads the new device driver from the at least one memory device to enable communication with the new device. For instance, one type of card reader in the EGM 1300 may be replaced with a second different type of card reader when device drivers for both card readers are stored in the at least one memory device.

In certain embodiments, the software units stored in the at least one memory device 1016 may be upgraded as needed. For instance, when the at least one memory device 1016 is a hard drive, new games, new game options, new parameters, new settings for existing parameters, new settings for new parameters, new device drivers, and new communication protocols may be uploaded to the at least one memory device 1016 from the MGC 1012 or from some other external device. As another example, when the at least one memory device 1016 includes a CD/DVD drive including a CD/DVD configured to store game options, parameters, and settings, the software stored in the at least one memory device 1016 may be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units may be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc.

In certain embodiments, in addition to the input, output and other components described in the first section above, the peripheral devices 1022 include several device interfaces, such as: (1) at least one output device 1020 including at least one display device (e.g., see display devices 300, 400, 500 of FIG. 1; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component(s) 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 300, 400, 500 configured to display any game(s) displayed by the EGM 1300 and any suitable information associated with such game(s). In certain embodiments, the display devices are connected to or mounted on a housing of the EGM 1300. In various embodiments, the display devices serve as digital glass configured to advertise certain games or other aspects of the gaming establishment in which the EGM is located. In various embodiments, the EGM 1300 includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. For example, the exemplary EGM 100 illustrated in FIG. 1 includes a first display device 300, a player tracking display, a credit display, and a bet display.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM 1300 are configured to display one or more game and/or non-game images, symbols, and indicia. In certain embodiments, the display devices of the EGM 1300 are configured to display any suitable visual representation or exhibition of the movement of objects; dynamic lighting; video images; images of people, characters, places, things, and faces of cards; and the like. In certain embodiments, the display devices of the EGM 1300 are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM 1300 receives an actuation of a cashout device (described below), the EGM 1300 causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. For example, the exemplary EGM 100 as illustrated in FIG. 1 may include a ticket printer and dispenser.

In certain embodiments, the at least one output device 1020 includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM 1300, such as an attract mode. For example, the exemplary EGM 100 illustrated in FIG. 1 includes a plurality of speakers. In another such embodiment, the EGM 1300 provides dynamic sounds coupled with attractive multimedia images displayed on one or more of the display devices to provide an audio-visual representation or to otherwise display full-motion video with sound to attract players to the EGM 1300. In certain embodiments, the EGM 1300 displays a sequence of audio and/or visual attraction messages during idle periods to attract potential players to the EGM 1300. The videos may be customized to provide any appropriate information.

The at least one input device 1030 may include any suitable device that enables an input signal to be produced and received by the at least one processor 1010 of the EGM 1300.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGM 100 illustrated in FIG. 1 may include a combined bill and ticket acceptor and a coin slot.

In certain embodiments, the at least one input device 1030 includes at least one wagering or betting device. In various embodiments, the one or more wagering or betting devices are each: (1) a mechanical button supported by the housing of the EGM 1300 (such as a hard key or a programmable soft key), or (2) an icon displayed on a display device of the EGM (described below) that is actuatable via a touch screen of the EGM (described below) or via use of a suitable input device of the EGM 1300 (such as a mouse or a joystick). One such wagering or betting device is a maximum wager or bet device that, when actuated, causes the EGM 1300 to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM 1300 to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM 1300 (such as a hard key or a programmable soft key), or (2) an icon displayed on a display device of the EGM (described below) that is actuatable via a touch screen of the EGM (described below) or via use of a suitable input device of the EGM 1300 (such as a mouse or a joystick). After a player appropriately funds the EGM 1300 and places a wager, the EGM 1300 activates the game play activation device to enable the player to actuate the game play activation device to initiate a play of a game on the EGM 1300 (or another suitable sequence of events associated with the EGM 1300). After the EGM 1300 receives an actuation of the game play activation device, the EGM 1300 initiates the play of the game. The exemplary EGM 100 illustrated in FIG. 1 may include a game play activation device in the form of a game play initiation button. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM 1300 (such as a hard key or a programmable soft key), or (2) an icon displayed on a display device of the EGM 1300 that is actuatable via a touch screen of the EGM 1300 or via use of a suitable input device of the EGM 1300 (such as a mouse or a joystick). When the EGM receives an actuation of the cashout device from a player and the player has a positive (i.e., greater-than-zero) credit balance, the EGM initiates a payout associated with the player's credit balance. The exemplary EGM 100 illustrated in FIG. 1 may include a cashout device in the form of a cashout button.

In various embodiments, the at least one input device 1030 includes a plurality of buttons that are programmable by the EGM 1300 operator to, when actuated, cause the EGM to perform particular functions. For instance, such buttons may be hard keys, programmable soft keys, or icons displayed on a display device of the EGM 1300 that are actuatable via a touch screen of the EGM 1300 or via use of a suitable input device of the EGM 1300 (such as a mouse or a joystick). The exemplary EGM 100 illustrated in FIG. 1 may include a plurality of such buttons.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM 1300 by touching the touch screen at the appropriate locations.

In embodiments including a player tracking system, as further described below, the at least one input device 1030 includes a card reader in communication with the at least one processor of the EGM. The exemplary EGM 100 illustrated in FIG. 1 may include a card reader. The card reader is configured to read a player identification card inserted into the card reader.

The at least one wireless communication component 1056 includes one or more communication interfaces having different architectures and utilizing a variety of protocols, such as (but not limited to) 802.11 (Wi-Fi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM 1300, such as one or more rechargeable power sources (e.g., rechargeable batteries) located at the EGM 1300.

In certain embodiments, in addition to the components described in the first section above, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM 1300 (in addition to the detections described above); detecting the presence and/or identity of various persons (e.g., players, casino employees, etc.), devices (e.g., user input devices), and/or systems within a predetermined proximity to the EGM 1300.

The at least one data preservation system 1062 is configured to detect or sense one or more events and/or conditions that, for example, may result in damage to the EGM 1300 and/or that may result in loss of information associated with the EGM 1300. Additionally, the data preservation system 1062 may be operable to initiate one or more appropriate action(s) in response to the detection of such events/conditions.

In addition to the player eye or head tracker 320, the EGM 1300 of the present disclosure may also include at least one motion/gesture analysis and interpretation component 1064 configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source 1068 enables the EGM 1300 to operate in a mobile environment. For example, in one embodiment, the EGM 100 of FIG. 1 includes one or more rechargeable batteries.

The at least one geolocation module 1076 is configured to acquire geolocation information from one or more remote sources and use the acquired geolocation information to determine information relating to a relative and/or absolute position of the EGM 1300. For example, in one implementation, the at least one geolocation module 1076 is configured to receive GPS signal information for use in determining the position or location of the EGM 1300. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM 1300.

The at least one user identification module 1077 is configured to determine the identity of the current user or current owner of the EGM 1300. For example, in one embodiment, the current user is required to perform a login process at the EGM 1300 in order to access one or more features. Alternatively, the EGM 1300 is configured to automatically determine the identity of the current user based on one or more external signals, such as an RFID tag or badge worn by the current user and that provides a wireless signal to the EGM 1300 that is used to determine the identity of the current user. In at least one embodiment, various security features are incorporated into the EGM 1300 to prevent unauthorized users from accessing confidential or sensitive information.

The at least one information filtering module 1079 is configured to perform filtering (e.g., based on specified criteria) of selected information to be displayed at one or more displays 300, 400, 500 of the EGM 1300.

In various embodiments, the EGM 1300 includes a plurality of communication ports configured to enable the at least one processor of the EGM 1300 to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

In certain embodiments, the EGM 1300 is a device that has obtained approval from a regulatory gaming commission, and in other embodiments, the EGM 1300 is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, remote processors, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM 1300 randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGM 1300 generates the game outcome(s) and/or the award(s) to be provided based on the associated probabilities. In these embodiments, since the EGM 1300 generates game outcomes and/or awards randomly or based on one or more probability calculations, there is no certainty that the EGM 1300 will ever provide any specific game outcome and/or award.

As noted above, in various embodiments, the EGM 1300 includes one or more executable game programs executable by at least one processor of the EGM 1300 to provide one or more primary games and one or more secondary games. The primary game(s) and the secondary game(s) may comprise any suitable games and/or wagering games, such as, but not limited to: electro-mechanical, video slot or spinning reel type games; video card games such as video draw poker, multi-hand video draw poker, other video poker games, video blackjack games, and video baccarat games; video keno games; video bingo games; and video selection games.

The flowcharts and block diagrams in the above figures illustrate the architecture, functionality, and operation of possible implementations of apparatuses, systems, methods and/or computer program products according to various embodiments of the present disclosure. In this regard, each block in the flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, may be implemented by special purpose hardware-based systems that perform the specified functions or acts, or combinations of special purpose hardware and computer instructions.

What is claimed is:

1. An electronic gaming machine (EGM), comprising:
- a base component;
- a display device supported by the base component;
- an enclosed master game controller (MGC) securely sealed within the base component by an MGC seal;
- a graphics card enclosure physically external to the MGC, wherein the graphics card enclosure includes a first slot for a graphical processing unit (GPU) add-in card and a second slot for a GPU add-in card;
- a first GPU add-in card in the first slot of the graphics card enclosure, wherein the first GPU add-in card is communicatively coupled to the display device and directly coupled to the MGC by plugging into a graphics card port in the first slot without breaking the MGC seal;
- a processor housed within the enclosed MGC;
- a GPU housed within the enclosed MGC; and
- a memory device housed within the enclosed MGC and storing a plurality of computer instructions.

2. The EGM of claim 1, wherein the port comprises a first expansion port and wherein the first GPU add-in card is connected by the first expansion port exposed through an opening in the enclosed MGC.

3. The EGM of claim 2, further comprising a graphics accelerator in the graphics card enclosure, the graphics accelerator having a second expansion port connected by a serial interface to the MGC.

4. The EGM of claim 1, wherein the base component further comprises one or more human interaction interface (HMI) devices, a power supply, one or more peripheral devices, and one or more means for receiving a wager or performing a cash-out operation.

5. The EGM of claim 3, wherein the graphics accelerator is integrated in at least one of a PC motherboard, a printed circuit board (PCB) connection means, and a graphics card.

6. The EGM of claim 1, wherein the graphics card enclosure is housed within the display device.

7. The EGM of claim 1, wherein the graphics card enclosure comprises a second GPU add-in card in the second slot, a power supply, an air exhaust system, and an air inlet.

8. The EGM of claim 1, wherein the graphics card enclosure is communicatively coupled to additional display devices of a plurality of additional EGMs.

9. The EGM of claim 1, wherein the plurality of computer instructions, when executed by the processor, cause the EGM to:
- display a play of a game via the display device, the game funded by one or more wagers; and
- enhance an image quality of a plurality of images displayed on the display device by use of the first GPU add-in card.

10. An electronic gaming machine (EGM), comprising:
- a base component;
- a display device supported by the base component;
- an enclosed master game controller (MGC) housed and securely sealed within the base component by an MGC seal;
- a graphics card enclosure physically external to the MGC, wherein the graphics card enclosure includes a first slot for a graphical processing unit (GPU) add-in card, a second slot for a GPU add-in card, and a third slot for a graphics accelerator;
- a first graphics accelerator in the third slot of the graphics card enclosure, wherein the third slot of the graphics card enclosure divides the first graphics accelerator from the first slot and the second slot thereby dissipating heat from the EGM;
- a first GPU add-in card in the first slot of the graphics card enclosure, wherein the first GPU add-in card is directly connected to the MGC via a port on the MGC;
- a serial interface cable connecting the graphics card enclosure to the MGC;
- a GPU housed within the enclosed MGC;
- a processor housed within the enclosed MGC; and
- a memory device housed within the enclosed MGC and storing a plurality of computer instructions.

11. The EGM of claim 10, wherein the graphics card enclosure is located within at least one of the base component and the display device.

12. The EGM of claim 10, wherein the graphics card enclosure further includes at least one of a PC motherboard, a printed circuit board (PCB) connection means, a second GPU add-in card, and graphics card expansion ports.

13. The EGM of claim 10, further comprising graphics card expansion ports externally located on the graphics card enclosure.

14. The EGM of claim 10, further comprising a second graphics accelerator external to the enclosed MGC and the graphics card enclosure.

15. The EGM of claim 10, wherein the base component further comprises at least a power supply, one or more peripheral devices, one or more human interaction interface (HMI) devices, and one or more means for receiving a wager or performing a cash-out operation.

16. The EGM of claim 10, wherein the graphics card enclosure includes at least one of a second GPU add-in card, a power supply, an air exhaust system, and an air inlet.

17. The EGM of claim 10, wherein the graphics card enclosure is coupled to additional display devices of a plurality of additional EGMs.

18. A gaming system comprising:

a graphics card enclosure physically external to an enclosed master game controller (MGC), wherein the graphics card enclosure includes a first slot for a graphical processing unit (GPU) add-in card and a second slot for a GPU add-in card, and wherein the enclosed MGC is securely sealed with an MGC seal to preserve a logical integrity of computer instructions contained within the enclosed MGC;

a first GPU add-in card in the first slot of the graphics card enclosure;

a processor; and a memory that stores the computer instructions which, when executed by the processor, causes the gaming system to:

cause a display device to display a play of a game through use of the enclosed MGC communicatively coupled to the graphics card enclosure located externally to the MGC; and enhance images associated with the game on the display device by accessing a graphics accelerator located externally to the enclosed MGC, the graphics accelerator having an expansion port connected to the MGC.

19. The gaming system of claim 18, wherein the computer instructions, when executed by the processor, cause the gaming system to activate the graphics accelerator upon detecting a signal communicated via the MGC.

20. The gaming system of claim 18, wherein the computer instructions, when executed by the processor, cause the gaming system to access the first GPU add-in card for purposes of enhancing images rendered by display devices of additional gaming systems.

* * * * *